US011885043B2

(12) United States Patent
Yoshikawa et al.

(10) Patent No.: US 11,885,043 B2
(45) Date of Patent: Jan. 30, 2024

(54) ACRYLIC FIBER FOR ARTIFICIAL HAIR, AND HEAD DECORATION PRODUCT INCLUDING SAME

(71) Applicant: KANEKA CORPORATION, Osaka (JP)

(72) Inventors: Megumi Yoshikawa, Hyogo (JP); Takao Michinobu, Hyogo (JP); Takeshi Tanaka, Hyogo (JP)

(73) Assignee: KANEKA CORPORATION, Osaka (JP)

( * ) Notice: Subject to any disclaimer, the term of this patent is extended or adjusted under 35 U.S.C. 154(b) by 550 days.

(21) Appl. No.: 17/171,374

(22) Filed: Feb. 9, 2021

(65) Prior Publication Data

US 2021/0164130 A1 Jun. 3, 2021

Related U.S. Application Data

(63) Continuation of application No. PCT/JP2019/023108, filed on Jun. 11, 2019.

(30) Foreign Application Priority Data

Aug. 23, 2018 (JP) ..... 2018-156446

(51) Int. Cl.
*D01D 5/253* (2006.01)
*D01F 6/38* (2006.01)
*A41G 3/00* (2006.01)

(52) U.S. Cl.
CPC ..... *D01D 5/253* (2013.01); *D01F 6/38* (2013.01); *A41G 3/0083* (2013.01); *D10B 2503/08* (2013.01)

(58) Field of Classification Search
CPC .. D01D 5/253; D01F 1/04; D01F 1/06; D01F 6/40; D01F 6/38; A41G 3/0083; D10B 2503/08
See application file for complete search history.

(56) References Cited

U.S. PATENT DOCUMENTS 5,677,059 A 10/1997 Kakita et al.
6,093,491 A * 7/2000 Dugan ..... D01F 8/14 428/397

(Continued)

FOREIGN PATENT DOCUMENTS

CN 105908271 A * 8/2016
EP 0600331 A1 6/1994

(Continued)

OTHER PUBLICATIONS

International Search Report issued in corresponding International Application No. PCT/JP2019/023108, dated Aug. 20, 2019, with translation (5 pages).

(Continued)

*Primary Examiner* — Jennifer A Steele
(74) *Attorney, Agent, or Firm* — Osha Bergman Watanabe & Burton LLP

(57) ABSTRACT

An acrylic fiber for artificial hair may include an acrylic copolymer. The acrylic fiber has a fiber cross section including 2 to 4 T-shaped protrusions that extend radially from a central portion. Each of the T-shaped protrusions has an arc-shaped upper side that bulges in a direction away from the central portion. A circumradius of the fiber cross section is 40.0 to 60.0 μm. A distance between adjacent end portions of the corresponding upper sides of the adjacent T-shaped protrusions is 3.0 to 60.0 μm. An axial width is 10.0 μm or more. Torsional rigidity of the acrylic fiber is 0.30 to 2.0 mg·cm$^2$. The acrylic fiber for artificial hair has high volume, good texture, and good twist processability, and a hair ornament may include the acrylic fiber for artificial hair.

9 Claims, 4 Drawing Sheets

(56) References Cited

U.S. PATENT DOCUMENTS

| | | | | |
|---|---|---|---|---|
| 2004/0127129 | A1* | 7/2004 | Luo | D02G 3/22 442/362 |
| 2008/0210250 | A1 | 9/2008 | Horihata et al. | |
| 2009/0266372 | A1* | 10/2009 | Higami | D01D 5/253 428/15 |
| 2016/0302504 | A1* | 10/2016 | Toki | D01D 5/253 |

FOREIGN PATENT DOCUMENTS

| | | | | |
|---|---|---|---|---|
| EP | 0742294 | A1 | 11/1996 | |
| EP | 3069625 | A1 | 9/2016 | |
| JP | S62299565 | A | 12/1987 | |
| JP | S6348652 | Y2 | 12/1988 | |
| JP | H06240510 | A | 8/1994 | |
| JP | H08296115 | A | 11/1996 | |
| JP | H08302519 | A | 11/1996 | |
| JP | 2010024586 | A | 2/2010 | |
| WO | 2004016838 | A2 | 2/2004 | |
| WO | 2006135060 | A1 | 12/2006 | |
| WO | 2008035712 | A1 | 3/2008 | |
| WO | WO-2008035712 | A1 * | 3/2008 | A41G 3/0083 |
| WO | 2015068771 | A1 | 5/2015 | |
| WO | WO-2015068771 | A1 * | 5/2015 | A41G 3/00 |

OTHER PUBLICATIONS

Written Opinion issued in corresponding International Application No. PCT/JP2019/023108, dated Aug. 20, 2019 (3 bages).

* cited by examiner

ACRYLIC FIBER FOR ARTIFICIAL HAIR, AND HEAD DECORATION PRODUCT INCLUDING SAME

TECHNICAL FIELD

One or more embodiments relate to acrylic fibers for artificial hair used for hair ornaments such as hairpieces, and hair ornaments including the acrylic fibers for artificial hair.

BACKGROUND

Acrylic fibers have conventionally been used as artificial hair for hair ornaments such as hairpieces because their texture is soft and similar to human hair. For example, Patent Document 1 proposes thermoplastic fibers as filaments for wig. The thermoplastic fibers have a hollow cross section including T-shaped protrusions that are arranged radially from the center. Both ends of one protrusion are substantially in contact with the ends of two adjacent protrusions, respectively.

Patent Document 1: Publication number of examined utility model JP S63(1988)-48652 Y2

However, the artificial hair fibers disclosed in Patent Document 1 have poor processability (twist processability) when two strands of the fibers are twisted together, although the fibers are excellent in texture and volume (bulkiness).

One or more embodiments provide acrylic fibers for artificial hair that have a high volume, a good texture, and good twist processability, and hair ornaments including the acrylic fibers for artificial hair.

SUMMARY

One or more embodiments relate to an acrylic fiber for artificial hair containing an acrylic copolymer. The acrylic fiber has a fiber cross section including 2 or more and 4 or less T-shaped protrusions that extend radially from a central portion. Each of the T-shaped protrusions has an arc-shaped upper side that bulges in a direction away from the central portion. A circumradius of the fiber cross section is 40.0 μm or more and 60.0 μm or less. A distance between adjacent end portions of the corresponding upper sides of the adjacent T-shaped protrusions is 3.0 μm or more and 60.0 μm or less. An axial width is 10.0 μm or more. Torsional rigidity of the acrylic fiber is 0.30 mg·cm$^2$ or more and 2.0 mg·cm$^2$ or less.

One or more embodiments also relate to a hair ornament including the acrylic fiber for artificial hair.

One or more embodiments can provide acrylic fibers for artificial hair that have a high volume, a good texture, and good twist processability, and hair ornaments including the acrylic fibers for artificial hair.

DETAILED DESCRIPTION

Some embodiments relate to acrylic fibers for artificial hair having a cross section including two or more T-shaped protrusions that extend radially from a central portion, and found that the acrylic fibers were able to have a high volume, a good texture, and good twist processability by meeting the following conditions. 1) The upper sides (also referred to as edges) of two adjacent T-shaped protrusions do not come into contact with each other, and a distance (also referred to as a "canal width" in the following) between the adjacent end portions of the corresponding upper sides of the two adjacent T-shaped protrusions is 3.0 μm or more and 60.0 μm or less. 2) The circumradius of the cross section is 40.0 μm or more and 60.0 μm or less. 3) The torsional rigidity of the acrylic fibers is 0.30 mg·cm$^2$ or more and 2.0 mg·cm$^2$ or less. Moreover, when the axial width is 10.0 μm or more, cracking of the fibers can be reduced. In one or more embodiments, the cross section of the fibers means a transverse section of the fibers.

Figure 3:
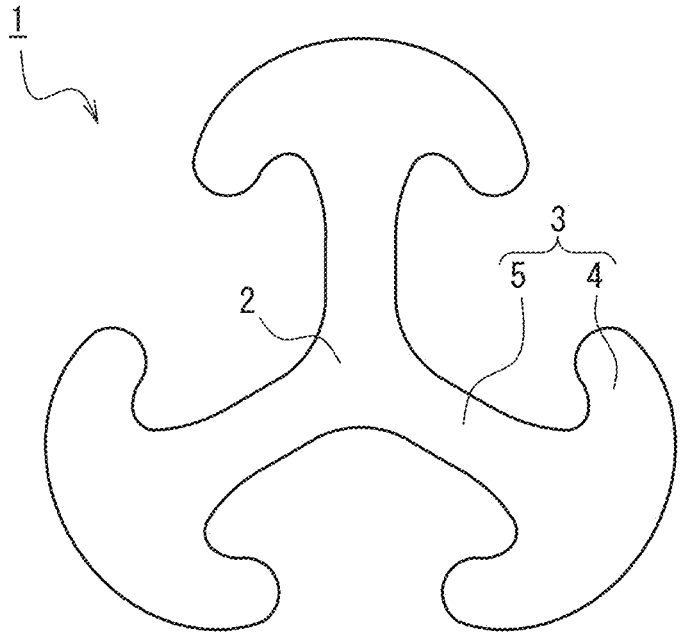
FIG. 3 is a schematic diagram illustrating a cross section of an acrylic fiber according to one or more embodiments.

In one or more embodiments, the fiber cross section of the acrylic fibers for artificial hair includes 2 or more and 4 or less T-shaped protrusions that extend radially from the central portion. The T-shaped protrusions are connected to each other at the central portion. Each of the T-shaped protrusions has an arc-shaped upper side that bulges in the direction away from the central portion. In one or more embodiments, the term "arc shape" refers to all shapes similar to the arc. For example, the arc shape may include not only an arc of a perfect circle, but also any shape that is considered to be the same as the arc based on common technical knowledge, such as a curved shape including a part of an ellipse. The arc shape may also include a linear portion in part. In one or more embodiments, the arc shape may either be or not be bilaterally symmetrical. The number of the T-shaped protrusions is not particularly limited, and may be 2 or more and 4 or less. From the viewpoint of further increasing the volume, the number of the T-shaped protrusions may be 3 or more. FIG. 3 is a schematic diagram illustrating a cross section of an acrylic fiber for artificial hair that includes three T-shaped protrusions. An acrylic fiber 1 for artificial hair has a cross section including three T-shaped protrusions 3 that extend radially from a central portion 2. Each of the T-shaped protrusions 3 has an arc-shaped upper side (portion) 4 that bulges in the direction away from the central portion 2. Each of the T-shaped protrusions 3 has a lower extended portion 5 as well as the upper side (portion) 4.

Figure 4:
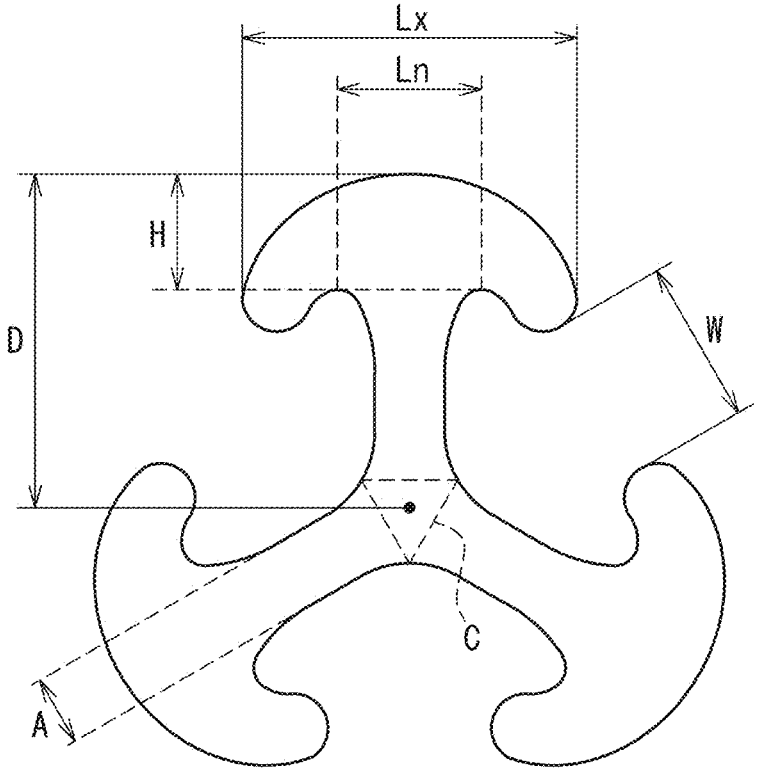
FIG. 4 is a schematic diagram illustrating a cross section of an acrylic fiber according to one or more embodiments.

In the acrylic fibers for artificial hair of one or more embodiments, the canal width of the fiber cross section is not particularly limited, and may be 13.0 μm or more, or 15.0 μm or more, e.g., from the viewpoint of further improving the twist processability. In one or more embodiments, the canal width of the fiber cross section is not particularly limited, and may be 16.0 μm or more, e.g., from the viewpoint of increasing the volume. In one or more embodiments, the canal width of the fiber cross section is not particularly limited, and may be 50.0 μm or less, 35.0 μm or less, 30.0 μm or less, 25.0 μm or less, or 20.0 μm or less, e.g., from the viewpoint of maintaining a better texture. In one or more embodiments, the "canal width of the fiber cross section" can be measured as described below. For example, the canal width is represented by W in FIG. 4.

In the acrylic fibers for artificial hair of one or more embodiments, the circumradius of the fiber cross section is not particularly limited, and may be 45.0 μm or more and 60.0 μm or less, e.g., from the viewpoint of further increasing the volume and maintaining a better texture. In one or more embodiments, the "circumradius of the fiber cross section" can be measured as described below. For example, the circumradius is represented by D in FIG. 4.

In the acrylic fibers for artificial hair of one or more embodiments, from the viewpoint of further improving the twist processability and the volume, the thickness of the upper side portion of at least one T-shaped protrusion may be 10% or more and 50% or less, or 25% or more and 45% or less of the circumradius of the fiber cross section. The average of the thicknesses of the upper side portions of all T-shaped protrusions may be 10% or more and 50% or less, or 25% or more and 45% or less of the circumradius of the fiber cross section. In one or more embodiments, the thickness of the upper side portion of a T-shaped protrusion means a vertical distance from the top of the upper side portion to a line connecting two points of intersection of the upper side portion with the lower extended portion of the T-shaped protrusion. In one or more embodiments, the top of the upper side portion of the T-shaped protrusion is farthest from the central portion of the fiber cross section. For example, the thickness of the upper side portion of the T-shaped protrusion is represented by H in FIG. 4.

In one or more embodiments, from the viewpoint of further improving the twist processability and the volume, the maximum length of the upper side portion of at least one T-shaped protrusion may be 1.5 times or more and 4 times or less, 1.9 times or more and 4 times or less, or 1.9 times or more and 2.6 times or less the minimum length of the upper side portion of the T-shaped protrusion. The average of the maximum lengths of the upper side portions of all T-shaped protrusions may be 1.5 times or more and 4 times or less, 1.9 times or more and 4 times or less, or 1.9 times or more and 2.6 times or less the average of the minimum lengths of the upper side portions of all the T-shaped protrusions. In one or more embodiments, the maximum length of the upper side portion of a T-shaped protrusion means a length between two end portions of the upper side portion, and the minimum length of the upper side portion of the T-shaped protrusion means a length of a line connecting two points of intersection of the upper side portion with the lower extended portion of the T-shaped protrusion. For example, the maximum length and the minimum length of the upper side portion of the T-shaped protrusion are represented by Lx and Ln in FIG. 4, respectively.

In the acrylic fibers for artificial hair of one or more embodiments, the flexural rigidity of the acrylic fibers is not particularly limited, and may be $4.0\times10^{-3}$ gf·cm$^2$/yarn or more, $5.0\times10^{-3}$ gf·cm$^2$/yarn or more, $6.0\times10^{-3}$ gf·cm$^2$/yarn or more, $7.0\times10^{-3}$ gf·cm$^2$/yarn or more, or $8.0\times10^{-3}$ gf·cm$^2$/yarn or more from the viewpoint of further increasing the volume. In one or more embodiments, the upper limit of the flexural rigidity is not particularly limited, and may be $15.0\times10^{-3}$ gf·cm$^2$/yarn or less, e.g., from the viewpoint of the texture.

In the acrylic fibers for artificial hair of one or more embodiments, the axial width of the fiber cross section is not particularly limited and may be 11.0 μm or more, 12.0 μm or more, or 13.0 μm or more, e.g., from the viewpoint of further reducing cracking of the fibers. In one or more embodiments, the axial width of the fiber cross section is not particularly limited and may be 26.0 μm or less, or 20.0 μm or less, e.g., from the viewpoint of further increasing the volume. In one or more embodiments, the "axial width of the fiber cross section" can be measured as described below. For example, the axial width is represented by A in FIG. 4.

In the acrylic fibers for artificial hair of one or more embodiments, the torsional rigidity of the acrylic fibers is 0.30 mg·cm$^2$ or more and 2.0 mg·cm$^2$ or less. When the torsional rigidity is within the above range, the acrylic fibers can enhance both the twist processability and the strength against an external force. In one or more embodiments, from the viewpoint of further improving the twist processability, the torsional rigidity may be 1.8 mg·cm$^2$ or less, 1.5 mg·cm$^2$ or less, or 1.3 mg·cm$^2$ or less. In one or more embodiments, the "torsional rigidity" can be measured as described below.

In one or more embodiments, the torsional rigidity is not particularly limited, and may be 0.70 mg·cm$^2$ or more, 0.80 mg·cm$^2$ or more, 0.90 mg·cm$^2$ or more, or 1.0 mg·cm$^2$ or more from the viewpoint of improving the curl setting properties with hot water (also referred to as HWS properties in the following).

In the acrylic fibers for artificial hair of one or more embodiments, the area of the central portion of the fiber cross section is not particularly limited, and may be 600.0 μm$^2$ or less 500.0 μm$^2$ or less, 300.0 μm$^2$ or less, or 250.0 μm$^2$ or less, e.g., from the viewpoint of further improving the twist processability. In one or more embodiments, the area of the central portion of the fiber cross section is not particularly limited and may be 70.0 μm$^2$ or more, or 100.0 μm$^2$ or more, e.g., from the viewpoint of reducing the cracking of the fibers. In one or more embodiments, the "area of the central portion of the fiber cross section" can be measured as described below. For example, the area of the central portion is the area of an equilateral triangle (central portion) represented by C in FIG. 4.

In one or more embodiments, an acrylic copolymer constituting the acrylic fibers for artificial hair is not particularly limited. For example, the acrylic copolymer may contain less than 95% by weight of acrylonitrile and more than 5% by weight of other monomers with respect to 100% by weight of the total amount of the acrylic copolymer. The acrylic copolymer may contain less than 80% by weight of acrylonitrile and more than 20% by weight of other monomers with respect to 100% by weight of the total amount of the acrylic copolymer. Specifically, the acrylic copolymer may contain 29.5% by weight or more and 79.5% by weight or less of acrylonitrile, 20% by weight or more and 70% by weight or less of vinyl chloride and/or vinylidene chloride, and 0.5% by weight or more and 5% by weight or less of a sulfonic acid group-containing vinyl monomer with respect to 100% by weight of the total amount of the acrylic copolymer. In other words, it is more preferable that the acrylic copolymer is obtained by polymerizing a total of 100% by weight of a monomer mixture containing 29.5% by weight or more and 79.5% by weight or less of acrylonitrile, 20% by weight or more and 70% by weight or less of vinyl chloride and/or vinylidene chloride, and 0.5% by weight or more and 5% by weight or less of a sulfonic acid group-containing vinyl monomer. When the content of acrylonitrile in the acrylic copolymer is 29.5% by weight or more and 79.5% by weight or less, the heat resistance is improved. When the content of vinyl chloride and/or vinylidene chloride in the acrylic copolymer is 20% by weight or more and 70% by weight or less, the flame retardancy is improved. When the acrylic copolymer contains 0.5% by weight or more and 5% by weight or less of a sulfonic acid group-containing vinyl monomer, the hydrophilicity is increased. It is further preferable that the acrylic copolymer contains 34.5% by weight or more and 74.5% by weight or less of acrylonitrile, 25% by weight or more and 65% by weight or less of vinyl chloride and/or vinylidene chloride, and 0.5% by weight or more and 5% by weight or less of a sulfonic acid group-containing vinyl monomer with respect to 100% by weight of the total amount of the acrylic copolymer. It is particularly preferable that the acrylic copolymer contains 39.5% by weight or more and 74.5% by weight or less of acrylonitrile, 25% by weight or more and 60% by weight or less of vinyl chloride, and 0.5% by weight or more and 5% by weight or less of a sulfonic acid group-containing vinyl monomer with respect to 100% by weight of the total amount of the acrylic copolymer. The acrylic copolymer may contain vinyl chloride from the viewpoint of excellent texture.

The sulfonic acid group-containing vinyl monomer is not particularly limited. Examples of the sulfonic acid group-containing vinyl monomer include allylsulfonic acid, methallylsulfonic acid, styrenesulfonic acid, isoprenesulfonic acid, 2-acrylamido-2-methylpropanesulfonic acid, and metal salts such as sodium salts thereof and amine salts thereof. These sulfonic acid group-containing vinyl monomers may be used individually or in combinations of two or more.

In one or more embodiments, from the viewpoint of further improving the texture, it is preferable that a fiber treatment agent adheres to the acrylic fibers for artificial hair. It is more preferable that the fiber treatment agent includes a fatty acid ester oil, a polyoxyethylene surfactant, and an aliphatic amide cationic compound. The fatty acid ester oil and the polyoxyethylene surfactant are generally used to improve the feel of acrylic fibers. The acrylic fibers have a better texture when the fatty acid ester oil and the polyoxyethylene surfactant are combined with the aliphatic amide cationic compound than when these components are used individually. The weight ratio of "the fatty acid ester oil and the polyoxyethylene surfactant" to the aliphatic amide cationic compound in the fiber treatment agent is not particularly limited, and may be in the range of 1:9 to 9:1 from the viewpoint of further improving the texture.

In one or more embodiments, from the viewpoint of further improving the texture, the amount of the fiber treatment agent adhered to 100 parts by weight of the acrylic fibers for artificial hair may be 0.1 parts by weight or more and 1.0 part by weight or less, 0.2 parts by weight or more and 0.9 parts by weight or less, or 0.3 parts by weight or more and 0.8 parts by weight or less. In one or more embodiments, the amount of the fiber treatment agent adhered to the acrylic fibers for artificial hair may be measured and calculated as described below.

In one or more embodiments, the acrylic fibers for artificial hair may also contain other additives as needed to modify the fiber characteristics unless they interfere with the effects of the acrylic fibers. Examples of additives include the following functional agents: gloss control agents such as titanium dioxide, silicon dioxide, and esters and ethers of cellulose derivatives including cellulose acetate; coloring agents such as organic pigments, inorganic pigments, and dyes; stabilizers for improving light resistance and/or heat resistance; fiber sizing agents such as a urethane polymer and a cationic ester polymer for improving the processability of the fibers during braiding or twisting; inorganic or organic deodorants for capturing isovaleric acid that is an odor component generated from the scalp; and aromatic agents for giving, e.g., a citrus aroma to the artificial hair fibers.

The acrylic fibers for artificial hair can be produced by wet spinning a spinning solution in which the acrylic copolymer is dissolved in an organic solvent. The organic solvent is not particularly limited, and a good solvent for the acrylic copolymer may be appropriately used. Examples of the organic solvent include methyl sulfoxide (DMSO), dimethylacetamide (DMAc), N,N-dimethylformamide (DMF), and acetone. Acetone may be use be from the viewpoint of versatility. Dimethyl sulfoxide may be used from the viewpoint of high safety. The spinning solution may contain a small amount of water, e.g., 1.5 to 4.8% by weight of water. This can reduce the formation of voids.

The spinning solution may contain an epoxy group-containing compound in an amount of 0.1 parts by weight or more, 0.2 parts by weight or more, or 0.3 parts by weight or more with respect to 100 parts by weight of the acrylic copolymer. The presence of the epoxy group-containing compound in the spinning solution can reduce, e.g., foul odor, coloring of the fibers due to heat, and devitrification of the fibers due to hot water. In particular, when dimethyl sulfoxide is used as the organic solvent, the epoxy group-containing compound can effectively reduce the generation of malodorous components caused by the decomposition of the dimethyl sulfoxide while the acrylic fibers are being heated. From the viewpoint of spinnability, fiber quality, and cost, the spinning solution may contain the epoxy group-containing compound in an amount of 5 parts by weight or less, 3 parts by weight or less, or 1 part by weight or less with respect to 100 parts by weight of the acrylic copolymer.

Examples of the epoxy group-containing compound include a glycidyl methacrylate-containing polymer, a glycidyl acrylate-containing polymer, an epoxidized vegetable oil, a glycidyl ether epoxy resin, a glycidyl amine epoxy resin, a glycidyl ester epoxy resin, and a cyclic aliphatic epoxy resin. These epoxy group-containing compounds may be used individually or in combinations of two or more.

From the viewpoint of epoxy equivalent (i.e., the weight of the resin containing 1 equivalent of epoxy group), suppressing the coloring of the fibers, the solubility in dimethyl sulfoxide, and reducing the elution into a spinning bath, the epoxy group-containing compound may be a glycidyl methacrylate-containing polymer, a glycidyl acrylate-containing polymer, and/or polyglycidyl methacrylate.

The weight average molecular weight of the epoxy group-containing compound is not particularly limited, and may be appropriately determined, e.g., in view of the solubility in dimethyl sulfoxide and the elution into the spinning bath. When the epoxy group-containing compound is a glycidyl methacrylate-containing polymer and/or a glycidyl acrylate-containing polymer, e.g., the weight average molecular weight may be 3000 or more from the viewpoint of reducing the elution into the spinning bath, and the weight average molecular weight may be 100000 or less from the viewpoint of the solubility in the organic solvent such as dimethyl sulfoxide.

The spinning solution may also contain other additives as needed to modify the fiber characteristics unless they interfere with the effects of the fiber. Examples of additives include gloss control agents such as titanium dioxide, silicon dioxide, and esters and ethers of cellulose derivatives including cellulose acetate, coloring agents such as organic pigments, inorganic pigments, and dyes, and stabilizers for improving light resistance and/or heat resistance.

The wet spinning includes at least a coagulation process, a water washing process, and a drying process. The wet spinning may include a bath drawing process that is to be performed before or after the water washing process and before the drying process. Moreover, the wet spinning may include an oil application process that is to be performed before the drying process. Further, the wet spinning may include a drawing process and a thermal relaxation process that are to be performed after the drying process.

First, in the coagulation process, the spinning solution is extruded through a spinning nozzle into a coagulation bath, where the extruded spinning solution is coagulated to form filaments (also referred to as coagulated filaments).

The spinning nozzle has a cross-sectional shape including 2 or more and 4 or less T-shaped protrusions that extend radially from a central portion. Each of the T-shaped protrusions has an arc-shaped upper side that bulges in the direction away from the central portion. For example, as shown in FIG. 1A to FIG. 1H, the spinning nozzle may have a cross-sectional shape including three T-shaped protrusions that extend radially from a central portion. Each of the T-shaped protrusions has an arc-shaped upper side that bulges in the direction away from the central portion. The spinning nozzle is not particularly limited, and may have, e.g., an axial width of 0.02 mm or more and 1.0 mm or less, a canal width of 0.02 mm or more and 1.0 mm or less, a circumdiameter of 0.01 mm or more and 1.0 mm or less, and a hole area of 0.05 $mm^2$ or more and 1.0 $mm^2$ or less.

The spinning speed is not particularly limited, and may be 2 m/min or more and 17 m/min or less, e.g., from the viewpoint of industrial productivity. The nozzle draft is not particularly limited, and may be 0.8 or more and 2.0 or less, e.g., from the viewpoint of the stability of the manufacturing process. The acrylic fibers with a predetermined cross-sectional shape and cross-sectional size can be obtained by appropriately adjusting the cross-sectional shape and cross-sectional size of the spinning nozzle and the spinning conditions such as the spinning speed and the nozzle draft.

The coagulation bath may contain an aqueous solution of the good solvent such as dimethyl sulfoxide with a concentration of 40% by weight or more and 70% by weight or less. The temperature of the coagulation bath may be 5° C. or more and 40° C. or less. If the concentration of the organic solvent in the coagulation bath is too low, the coagulation is accelerated, and thus it is likely that a coagulation structure will be rough and voids will be formed inside the fibers.

Next, in the bath drawing process, the acrylic fibers (coagulated filaments) may be drawn in a drawing bath (also referred to as "primary drawing"). The drawing bath may contain an aqueous solution of the good solvent such as dimethyl sulfoxide with a lower concentration than that of the coagulation bath. The temperature of the drawing bath may be 30° C. or more, 40° C. or more, or 50° C. or more. The draw ratio is not particularly limited, and may be 2 to 8 times from the viewpoint of improving the fiber strength and the productivity. When the primary drawing uses a water bath, the bath drawing process may be performed after the water washing process, as will be described later, or the primary drawing and water washing may be performed simultaneously.

Next, in the water washing process, the acrylic fibers are washed with warm water at 30° C. or more to remove the good solvent such as dimethyl sulfoxide from the acrylic fibers. Alternatively, the coagulated filaments may be introduced into warm water at 30° C. or more, and subjected to the primary drawing together with water washing. In the water washing process, the use of warm water at 70° C. or more makes it easier to remove the good solvent such as dimethyl sulfoxide in the acrylic fibers.

The fiber treatment agent including the fatty acid ester oil, the polyoxyethylene surfactant, and the aliphatic amide cationic compound is dissolved or dispersed in water (also referred to as an oil solution) when used in the oil application process. Specifically, it is preferable that the fiber treatment agent with a predetermined concentration is introduced into an oil bath, and the filaments that have been subjected to the water washing process are immersed in the oil bath so that the fiber treatment agent is applied to the acrylic fibers. The temperature of the oil bath is not particularly limited, and may be, e.g., 40° C. or more, or may also be 40° C. or more and 80° C. or less. The immersion time is not particularly limited, and may be, e.g., 1 second or more and 10 seconds or less, or may also be 1 second or more and 5 seconds or less.

The oil solution may also contain other additives as needed to modify the fiber characteristics unless they interfere with the effects of the fiber. Examples of additives include fiber sizing agents such as a urethane polymer and a cationic ester polymer.

Next, in the drying process, the acrylic fibers to which the fiber treatment agent has been applied are dried. The drying temperature is not particularly limited and may be, e.g., 110° C. or more and 190° C. or less. Then, the dried fibers may further be drawn as needed (secondary drawing). The drawing temperature of the secondary drawing is not particularly limited, and may be, e.g., 110° C. or more and 190° C. or less. The draw ratio is not particularly limited, and may be, e.g., 1 to 4 times. The total draw ratio, including the bath drawing before the drying process, may be 2 to 12 times.

The fibers that have been dried or the fibers that have been dried and then drawn may be relaxed in the thermal relaxation process. The relaxation rate is not particularly limited, and may be, e.g., 5% or more, or 10% or more and 30% or less. The thermal relaxation treatment can be performed in a dry heat atmosphere or a superheated steam atmosphere at a high temperature, e.g., at 150° C. or more and 200° C. or less.

The single fiber fineness of the acrylic fibers for artificial hair may be 10 dtex or more and 100 dtex or less, or 20 dtex or more and 95 dtex or less from the viewpoint of making the acrylic fibers suitable for artificial hair.

The acrylic fibers for artificial hair can be used to produce hair ornaments. The hair ornaments may include other artificial hair fibers in addition to the above acrylic fibers for artificial hair. The other artificial hair fibers are not particularly limited and may be, e.g., polyvinyl chloride fibers, nylon fibers, polyester fibers, or regenerated collagen fibers.

The hair ornaments may include, e.g., fiber bundles for hair, hair weaves, wigs, braids, toupee, hair extensions, and hair accessories.

EXAMPLES

Hereinafter, one or more embodiments will be described by way of examples. However, these one or more embodiments are not limited to the following examples.

Example 1

Figure 1A:
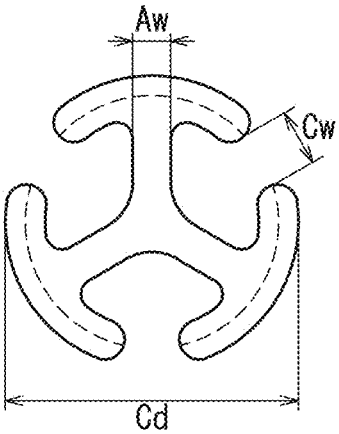
FIGS. 1A-1H are schematic cross-sectional views illustrating nozzles used in the Examples.

An acrylic copolymer containing 46% by weight of acrylonitrile, 52% by weight of vinyl chloride, and 2% by weight of sodium styrenesulfonate was dissolved in dimethyl sulfoxide to prepare a resin solution having a resin concentration of 28.0% by weight and a water concentration of 3.5% by weight. Next, carbon black, a red dye (C.I. Basic Red 46), and a blue dye (C.I. Basic Blue 41) were added as coloring agents to the resin solution in an amount of 2.1 parts by weight, 0.04 parts by weight, and 0.07 parts by weight with respect to 100 parts by weight of the acrylic copolymer, respectively. Moreover, polyglycidyl methacrylate (weight average molecular weight: 12000) was added to this solution in an amount of 1.0 part by weight with respect to 100 parts by weight of the acrylic copolymer, resulting in a spinning solution. Using a spinning nozzle with a shape as shown in FIG. 1A and a size as shown in Table 1, the spinning solution was extruded into a coagulation bath containing a DMSO aqueous solution with a concentration of 52% by weight at 20° C. so that wet spinning was performed at a spinning speed of 2 m/min and a nozzle draft of 1.15. Then, the coagulated filaments were drawn to 2.4 times their original length in a drawing bath containing a DMSO aqueous solution with a concentration of 30% by weight at 90° C. Subsequently, the filaments were washed with warm water at 80° C. Next, the water-washed primary drawn yarns were immersed in an oil bath (60° C.) for 3 to 5 seconds. The oil bath contained a fiber treatment agent (including a fatty acid ester oil and a polyoxyethylene surfactant with a total concentration of 6% by weight). Thus, the drawn yarns were impregnated with the fiber treatment agent. Thereafter, the drawn yarns were dried at 140° C. and further drawn to 2 times. The resulting yarns were subjected to a 20% relaxation treatment at 160° C. to provide acrylic fibers (the amount of adhesion of the fiber treatment agent: 0.60 parts by weight) having a single fiber fineness of about 51 dtex.

Example 2

Figure 1E:
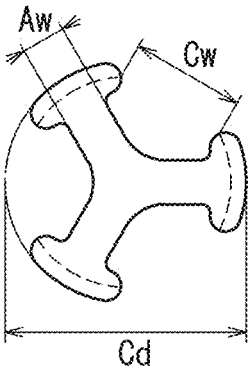
Figure 1B:
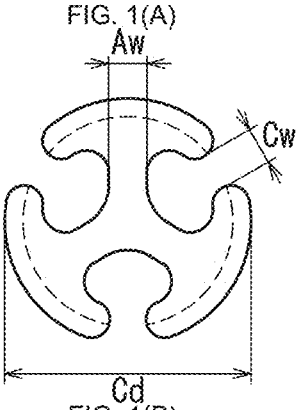

Acrylic fibers (the amount of adhesion of the fiber treatment agent: 0.60 parts by weight) having a single fiber fineness of about 51 dtex were produced in the same manner as Example 1, except that a spinning nozzle with a shape as shown in FIG. 1B and a size as shown in Table 1 was used, and wet spinning was performed at a nozzle draft of 1.26.

Example 3

Acrylic fibers (the amount of adhesion of the fiber treatment agent: 0.60 parts by weight) having a single fiber fineness of about 51 dtex were produced in the same manner as Example 2, except that wet spinning was performed at a spinning speed of 8 m/min.

Example 4

Figure 1F:
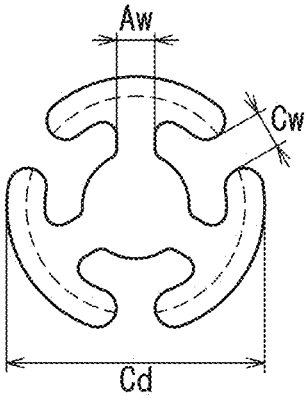
Figure 1C:
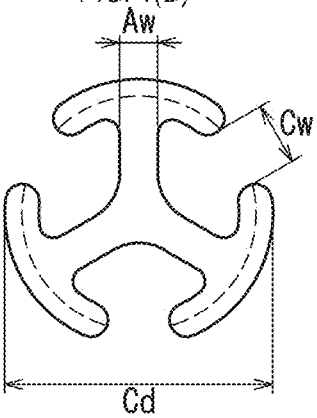

Acrylic fibers (the amount of adhesion of the fiber treatment agent: 0.60 parts by weight) having a single fiber fineness of about 51 dtex were produced in the same manner as Example 2, except that a spinning nozzle with a shape as shown in FIG. 1C and a size as shown in Table 1 was used, the spinning solution was extruded into the coagulation bath containing a DMSO aqueous solution with a concentration of 62% by weight at 20° C. so that wet spinning was performed, and then the coagulated filaments were drawn to 2.8 times their original length in the drawing bath containing a DMSO aqueous solution with a concentration of 50% by weight at 90° C.

Example 5

Figure 1G:
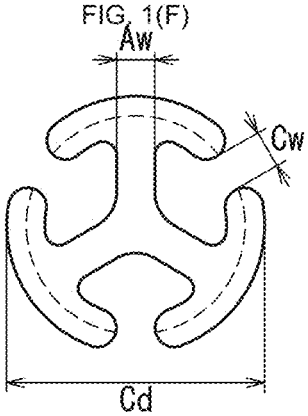
Figure 1D:
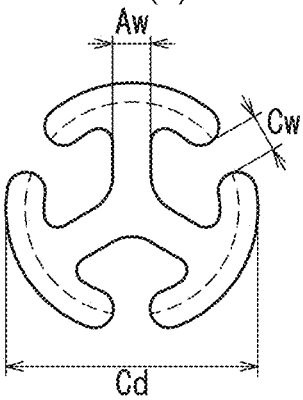

Acrylic fibers (the amount of adhesion of the fiber treatment agent: 0.60 parts by weight) having a single fiber fineness of about 51 dtex were produced in the same manner as Example 2, except that a spinning nozzle with a shape as shown in FIG. 1D and a size as shown in Table 1 was used, the spinning solution was extruded into the coagulation bath containing a DMSO aqueous solution with a concentration of 47% by weight at 35° C. so that wet spinning was performed, and then the coagulated filaments were drawn in the drawing bath containing a DMSO aqueous solution with a concentration of 40% by weight at 90° C.

Example 6

Acrylic fibers (the amount of adhesion of the fiber treatment agent: 0.60 parts by weight) having a single fiber fineness of about 46 dtex were produced in the same manner as Example 5, except that the coagulation bath contained a DMSO aqueous solution with a concentration of 52% by weight at 20° C., wet spinning was performed at a nozzle draft of 1.31, and a 18.7% relaxation treatment was performed.

Example 7

Acrylic fibers (the amount of adhesion of the fiber treatment agent: 0.60 parts by weight) having a single fiber fineness of about 46 dtex were produced in the same manner as Example 6, except that a fiber treatment agent (including a fatty acid ester oil and a polyoxyethylene surfactant with a total concentration of 4.5% by weight and an aliphatic amide cationic compound with a concentration of 1.5% by weight) was introduced into the oil bath (60° C.), and the filaments were impregnated with the fiber treatment agent. The aliphatic amide cationic compound was "SUNSOFLON PXP-709" (product name) manufactured by NICCA CHEMICAL CO., LTD.

Example 8

Acrylic fibers (the amount of adhesion of the fiber treatment agent: 0.60 parts by weight) having a single fiber fineness of about 46 dtex were produced in the same manner as Example 7, except that a fiber treatment agent (inducting an aliphatic amide cationic compound with a concentration of 4.5% by weight) was introduced into the oil bath (60° C.), and the filaments were impregnated with the aliphatic amide cationic compound. The aliphatic amide cationic compound was "SUNSOFLON PXP-709" (product name) manufactured by NICCA CHEMICAL CO., LTD.

Example 9

Acrylic fibers (the amount of adhesion of the fiber treatment agent: 0.60 parts by weight) having a single fiber fineness of about 51 dtex were produced in the same manner as Example 1, except that a spinning nozzle with a shape as shown in FIG. 1E and a size as shown in Table 1 was used, wet spinning was performed at a nozzle draft of 1.26, and then a 26% relaxation treatment was performed.

Example 10

Acrylic fibers (the amount of adhesion of the fiber treatment agent: 0.60 parts by weight) having a single fiber fineness of about 51 dtex were produced in the same manner as Example 9, except that wet spinning was performed in the coagulation bath containing a DMSO aqueous solution with a concentration of 57% by weight at 35° C.

Example 11

An acrylic copolymer containing 49% by weight of acrylonitrile, 50% by weight of vinyl chloride, and 1% by weight of sodium styrenesulfonate was dissolved in acetone to prepare a resin solution having a resin concentration of 28.0% by weight. Next, carbon black, a cationic liquid red dye, and a cationic liquid blue dye (in which the cationic liquid red and blue dyes were manufactured by Hodogaya Chemical Co., Ltd) were added as coloring agents to the resin solution in an amount of 0.6 parts by weight, 0.25 parts by weight, and 0.4 parts by weight with respect to 100 parts by weight of the acrylic copolymer, respectively. Moreover, polyglycidyl methacrylate (weight average molecular weight: 12000) was added to this solution in an amount of 1.0 part by weight with respect to 100 parts by weight of the acrylic copolymer, resulting in a spinning solution. Using a spinning nozzle with a shape as shown in FIG. 1D and a size as shown in Table 1, the spinning solution was extruded into a coagulation bath containing an acetone aqueous solution with a concentration of 40% by weight at 25° C. so that wet spinning was performed at a spinning speed of 3 m/min and a nozzle draft of 1.26. Then, the solvent was removed by hot water at 75° C. and the coagulated filaments were drawn to 2.2 times their original length. Next, the water-washed primary drawn yarns were immersed in an oil bath (60° C.) for 3 to 5 seconds. The oil bath contained a fiber treatment agent (including a fatty acid ester oil and a polyoxyethylene surfactant with a total concentration of 1.8% by weight). Thus, the drawn yarns were impregnated with the oil. Thereafter, the drawn yarns were dried at 110° C. and further drawn to 2.3 times. The resulting yarns were subjected to a 26% relaxation treatment at 140 to 145° C. to provide acrylic fibers (the amount of adhesion of the fiber treatment agent: 0.59 parts by weight) having a single fiber fineness of about 46 dtex.

Examples 12

Acrylic fibers (the amount of adhesion of the fiber treatment agent: 0.81 parts by weight) having a single fiber fineness of about 43 dtex were produced in the same manner as Example 11, except that wet spinning was performed using a spinning nozzle with a shape as shown in FIG. 1D and a size as shown in Table 1, the filaments were immersed in the oil bath containing a fiber treatment agent with a concentration of 2.2% by weight for 3 to 5 seconds so that the filaments were impregnated with the oil, and the filaments were dried and then drawn to 2.5 times.

Example 13

Acrylic fibers (the amount of adhesion of the fiber treatment agent: 0.80 parts by weight) having a single fiber fineness of about 46 dtex were produced in the same manner as Example 11, except that a spinning nozzle with a shape as shown in FIG. 1C and a size as shown in Table 1 was used, wet spinning was performed at a nozzle draft of 1.42, and the filaments were immersed in the oil bath containing a fiber treatment agent with a concentration of 3.3% by weight for 3 to 5 seconds so that the filaments were impregnated with the oil.

Example 14

Acrylic fibers (the amount of adhesion of the fiber treatment agent: 0.83 parts by weight) having a single fiber fineness of about 46 dtex were produced in the same manner as Example 11, except that a spinning nozzle with a shape as shown in FIG. 1A and a size as shown in Table 1 was used, and the filaments were immersed in the oil bath containing a fiber treatment agent with a concentration of 22% by weight for 3 to 5 seconds so that the filaments were impregnated with the oil.

Example 15

Acrylic fibers (the amount of adhesion of the fiber treatment agent: 0.65 parts by weight) having a single fiber fineness of about 46 dtex were produced in the same manner as Example 11, except that a spinning nozzle with a shape as shown in FIG. 1D and a size as shown in Table 1 was used, and the filaments were immersed in the oil bath containing a fiber treatment agent with a concentration of 22% by weight for 3 to 5 seconds so that the filaments were impregnated with the oil.

Example 16

Acrylic fibers (the amount of adhesion of the fiber treatment agent: 0.75 parts by weight) having a single fiber fineness of about 46 dtex were produced in the same manner as Example 11, except that a spinning nozzle with a shape as shown in FIG. 1B and a size as shown in Table 1 was used, wet spinning was performed at a spinning speed of 8 m/min and a nozzle draft of 1.24, the filaments were immersed in the oil bath containing a fiber treatment agent with a concentration of 2.6% by weight for 3 to 5 seconds so that the filaments were impregnated with the oil, the filaments were dried and then drawn to about 1.7 times, and a 10% relaxation treatment was performed.

Example 17

Acrylic fibers (the amount of adhesion of the fiber treatment agent: 0.88 parts by weight) having a single fiber fineness of about 51 dtex were produced in the same manner as Example 11, except that a spinning nozzle with a shape as shown in FIG. 1F and a size as shown in Table 1 was used, wet spinning was performed at a spinning speed of 3 m/min and a nozzle draft of 1.08, the filaments were immersed in the oil bath containing a fiber treatment agent with a concentration of 2.6% by weight for 3 to 5 seconds so that the filaments were impregnated with the oil, and the filaments were dried and then drawn to 2 times.

Example 18

Acrylic fibers (the amount of adhesion of the fiber treatment agent: 0.90 parts by weight) having a single fiber fineness of about 51 dtex were produced in the same manner as Example 11, except that a spinning nozzle with a shape as shown in FIG. 1G and a size as shown in Table 1 was used, wet spinning was performed at a spinning speed of 3 m/min and a nozzle draft of 1.07, the filaments were immersed in the oil bath containing a fiber treatment agent with a concentration of 2.6% by weight for 3 to 5 seconds so that the filaments were impregnated with the oil, and the filaments were dried and then drawn to 2 times.

Example 19

Figure 1H:
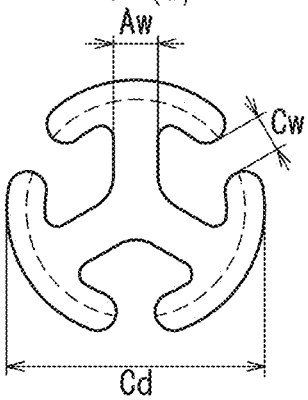

Acrylic fibers (the amount of adhesion of the fiber treatment agent: 0.85 parts by weight) having a single fiber fineness of about 51 dtex were produced in the same manner as Example 11, except that a spinning nozzle with a shape as shown in FIG. 1H and a size as shown in Table 1 was used, wet spinning was performed at a spinning speed of 3 m/min and a nozzle draft of 1.14, the filaments were immersed in the oil bath containing a fiber treatment agent with a concentration of 2.6% by weight for 3 to 5 seconds so that the filaments were impregnated with the oil, and the filaments were dried and then drawn to 2 times.

Comparative Example 1

Figure 2A:
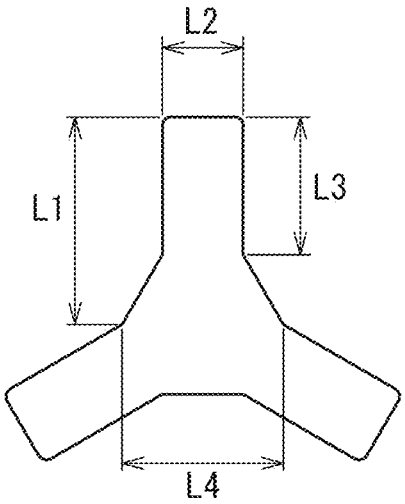
FIGS. 2A-2C are schematic cross-sectional views illustrating nozzles used in the Comparative Examples.

An acrylic copolymer containing 49% by weight of acrylonitrile, 50% by weight of vinyl chloride, and 1% by weight of sodium styrenesulfonate was dissolved in acetone to prepare a resin solution having a resin concentration of 28.0% by weight. Next, carbon black, a cationic liquid red dye, and a cationic liquid blue dye (in which the cationic liquid red and blue dyes were manufactured by Hodogaya Chemical Co., Ltd) were added as coloring agents to the resin solution in an amount of 0.6 parts by weight, 0.25 parts by weight, and 0.4 parts by weight with respect to 100 parts by weight of the acrylic copolymer, respectively. Moreover, polyglycidyl methacrylate (weight average molecular weight: 12000) was added to this solution in an amount of 1.0 part by weight with respect to 100 parts by weight of the acrylic copolymer, resulting in a spinning solution. Using a spinning nozzle with a shape as shown in FIG. 2A and a size as shown in Table 2, the spinning solution was extruded into a coagulation bath containing an acetone aqueous solution with a concentration of 20% by weight at 20° C. so that wet spinning was performed at a spinning speed of 2 m/min and a nozzle draft of 1.10. Then, the solvent was removed by hot water at 60° C. and the coagulated filaments were drawn to 1.5 times their original length. Next, the water-washed primary drawn yarns were immersed in an oil bath (60° C.) for 3 to 5 seconds. The oil bath contained a fiber treatment agent (including a fatty acid ester oil and a polyoxyethylene surfactant with a total concentration of 6% by weight). Thus, the drawn yarns were impregnated with the oil. Thereafter, the drawn yarns were dried at 130° C. and further drawn to 2.5 times. The resulting yarns were subjected to a 20% relaxation treatment at 160° C. to provide acrylic fibers (the amount of adhesion of the fiber treatment agent: 0.60 parts by weight) having a single fiber fineness of about 51 dtex.

Comparative Example 2

Figure 2C:
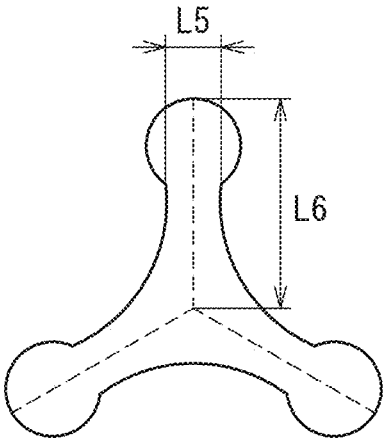
Figure 2B:
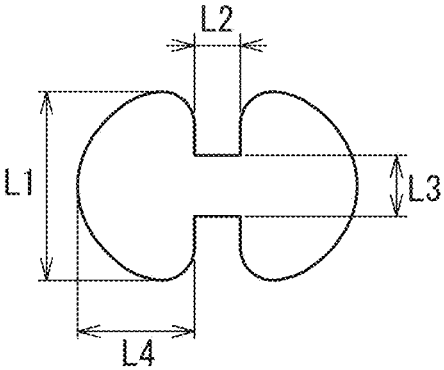

Acrylic fibers (the amount of adhesion of the fiber treatment agent: 0.60 parts by weight) having a single fiber fineness of about 46 dtex were produced in the same manner as Example 6, except that a spinning nozzle with a shape as shown in FIG. 2B and a size as shown in Table 2 was used.

Comparative Example 3

Acrylic fibers (the amount of adhesion of the fiber treatment agent: 0.60 parts by weight) having a single fiber fineness of about 51 dtex were produced in the same manner as Example 1, except that a spinning nozzle with a shape as shown in FIG. 2C and a size as shown in Table 2 was used, the spinning solution was extruded into the coagulation bath containing a DMSO aqueous solution with a concentration of 57% by weight at 20° C. so that wet spinning was performed at a nozzle draft of 1.33, and then the coagulated filaments were drawn to 2.8 times their original length in the drawing bath containing a DMSO aqueous solution with a concentration of 50% by weight at 90° C.

The amount of adhesion of the fiber treatment agent in Examples 1 to 19 and Comparative Examples 1 to 3 was measured and calculated in the following manner.

(Amount of Adhesion of Fiber Treatment Agent)

A sample (fiber) of about 2 g (sample weight W0) was cut into 12 to 15 cm and packed in a stainless steel tube (oil extraction tube) having a hole of about 1 mm at the lower end. Next, 35 mL of a mixed solution of ethanol:cyclohexane=1:1 (weight ratio) was prepared as an extract for the fiber treatment agent, and about 20 mL of the extract was to be put in the oil extraction tube. The lid of the oil extraction tube was adjured so that the drop rate of the extract was about 1 drop per 1 to 1.5 seconds. Then, the extraction of the fiber treatment agent was started. In this case, a tray (empty tray weight W1) heated to 120° C. by a heater was used as a saucer for liquid drops and placed in such a way that the dropping liquid fell there. When the dropping was finished, the lid was once removed, and the fibers present in the oil extraction tube were pushed with a stainless steel rod to squeeze the extract. This operation was repeated by using the remaining extract (about 15 mL). Upon the completion of the extraction, the tray was placed in an oven at 90° C. and taken out of the oven after 5 minutes. Consequently, the extract dried out and only the fiber treatment agent remained on the tray. The total weight (W2) of this tray was measured, and the amount of the fiber treatment agent adhered to 100 parts by weight of the fibers was calculated by the following formula:

$$\text{Amount of oil adhered (parts by weight)}=(W2-W1)/(W0-W1-W2)\times 100.$$

TABLE 1

| | Nozzle shape | Nozzle size Aw* (mm) | Cw* (mm) | Cd* (mm) | Hole area ($mm^2$) |
|---|---|---|---|---|---|
| Ex. 1 | FIG. 1A | 0.06 | 0.09 | 0.45 | 0.0850 |
| Ex. 2 | FIG. 1B | 0.06 | 0.06 | 0.41 | 0.0842 |
| Ex. 3 | FIG. 1B | 0.06 | 0.06 | 0.41 | 0.0842 |
| Ex. 4 | FIG. 1C | 0.06 | 0.10 | 0.50 | 0.0975 |
| Ex. 5 | FIG. 1D | 0.06 | 0.06 | 0.43 | 0.0857 |
| Ex. 6 | FIG. 1D | 0.06 | 0.06 | 0.43 | 0.0857 |
| Ex. 7 | FIG. 1D | 0.06 | 0.06 | 0.43 | 0.0857 |
| Ex. 8 | FIG. 1D | 0.06 | 0.06 | 0.43 | 0.0857 |
| Ex. 9 | FIG. 1E | 0.07 | 0.18 | 0.45 | 0.0718 |
| Ex. 10 | FIG. 1E | 0.07 | 0.18 | 0.45 | 0.0718 |
| Ex. 11 | FIG. 1D | 0.06 | 0.06 | 0.43 | 0.0857 |
| Ex. 12 | FIG. 1D | 0.06 | 0.06 | 0.43 | 0.0857 |
| Ex. 13 | FIG. 1C | 0.06 | 0.10 | 0.50 | 0.0975 |
| Ex. 14 | FIG. 1A | 0.06 | 0.09 | 0.45 | 0.0850 |
| Ex. 15 | FIG. 1D | 0.06 | 0.06 | 0.43 | 0.0857 |
| Ex. 16 | FIG. 1B | 0.06 | 0.06 | 0.41 | 0.0842 |
| Ex. 17 | FIG. 1F | 0.06 | 0.06 | 0.45 | 0.0962 |
| Ex. 18 | FIG. 1G | 0.06 | 0.06 | 0.45 | 0.0953 |
| Ex. 19 | FIG. 1H | 0.07 | 0.06 | 0.45 | 0.1013 |

Aw*: axial width;
Cw*: canal width;
Cd*: circumdiameter

TABLE 2

| | Nozzle shape | Nozzle size L1 (mm) | L2 (mm) | L3 (mm) | L4 (mm) | Hole area ($mm^2$) |
|---|---|---|---|---|---|---|
| Comp. Ex. 1 | FIG. 2A | 0.312 | 0.121 | | | 0.1134 |
| Comp. Ex. 2 | FIG. 2B | 0.279 | 0.07 | 0.088 | 0.175 | 0.08538 |
| Comp. Ex. 3 | FIG. 2C | L5 = 0.08 mm | | L6 = 0.315 mm | | 0.0966 |

Figure 5:
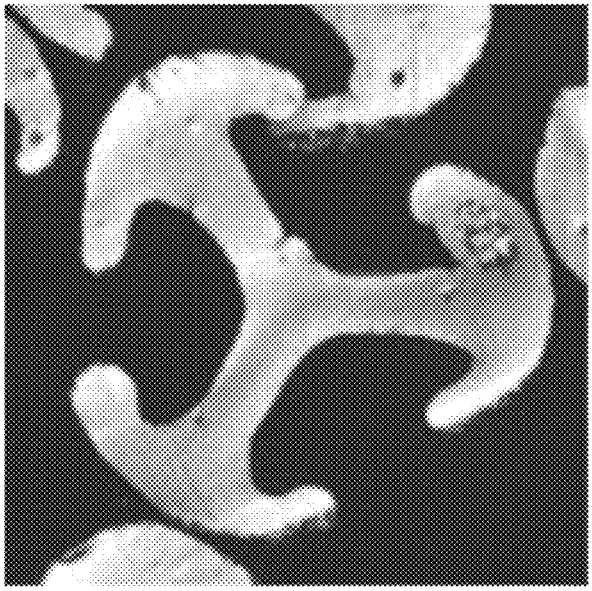
FIG. 5 is a micrograph (400×) of a cross section of an acrylic fiber in Example 5.

The cross sections of the acrylic fibers in Examples 1 to 19 and Comparative Examples 1 to 3 were observed with a microscope in the following manner. For example, FIG. 5 shows a photograph (400×) of the fiber cross section of the acrylic fibers in Example 5. Moreover, the image analysis was performed in the following manner by using the photographs of the fiber cross sections to measure the circumradius, the distance (canal width) between the adjacent end portions of the corresponding upper sides of two adjacent T-shaped protrusions, the axial width, and the area of the central portion. Table 3 shows the results. The torsional rigidity and flexural rigidity of the acrylic fibers in Examples 1 to 19 and Comparative Examples 1 to 3 were measured and evaluated in the following manner. Table 3 shows the results. The volume, texture, twist processability, and HWS properties of the acrylic fibers in Examples 1 to 19 and Comparative Examples 1 to 3 were measured and evaluated in the following manner. Table 3 shows the results. Using the photographs of the fiber cross sections, the thicknesses (H), the maximum lengths (Lx), and the minimum lengths (Ln) of the upper sides of three T-shaped protrusions were measured and their respective average values were shown in Table 4. Table 4 also shows H/circumradius (%) and Lx/Ln (times).

(Method for Observing Fiber Cross Section)

<Preparation of Sample>

Acrylic fibers were cut into 15 cm long, and an appropriate amount of the acrylic fibers were packed in a heat-shrinkable tube (manufactured by Junkosha Inc., model number "FEP-040," inner diameter before shrinkage: φ4.5 mm, inner diameter after shrinkage: φ3.3 mm, length: 1 m). The tube was allowed to stand in an oven at 105° C. for 5 minutes. Then, the tube was taken out of the oven and left cooling. After the heat-shrinkable tube was cooled, the tube that had shrunk and been filled with the acrylic fibers was cut to a length of about 3 mm with a razor blade. Thus, samples for observation of the fiber cross section were prepared.

<Observation and Photography>

The samples for observation of the fiber cross section were observed and photographed with a laser microscope (VK-X260, manufactured by KEYENCE CORPORATION) in a range of observation and measurement of 675 μm in width×506 μm in length. The observation and photography were performed at a total of 5 points of each of the samples.

(Method for Analyzing Photograph of Fiber Cross Section)

The photographs of the fiber cross sections were input to the image analysis software (WinROOF, available from Mitsubishi Corporation). The following parameters were defined and measurements were performed.

<Circumradius>

The cross sections were selected, each of which had three base lines crossing each other at an angle of 120°±15°. Then, a circle passing through three points on the perimeter of one cross section was created and defined as a circumcircle. The average of the radii of the circumcircles of a total of three cross sections was calculated and determined as a circumradius. For example, the circumradius is represented by D in FIG. 4. Each of the three base lines was a center line of the axial width.

<Canal Width>

The cross sections were selected, each of which had three base lines crossing each other at an angle of 120°±15°. Then, a distance (point-to-point distance) between the adjacent end portions of the corresponding upper sides of two adjacent protrusions was measured. The distance was measured at nine points in total (i.e., 3 cross sections×3 locations), and the average of the measured distances was determined as a canal width. For example, the canal width is represented by W in FIG. 4.

<Axial Width>

Any cross section was selected, and the smallest width of the axes along three base lines was measured. For example, the axial width is represented by A in FIG. 4.

<Area of Central Portion>

First, the cross sections were selected, each of which had three base lines crossing each other at an angle of 120°±15°. Next, for the cross sections including three protrusions, three sides of an inscribed triangle in the central portion were measured (5 cross sections×3 sides), and the average of the sides was determined as the length of one side of the triangle. Based on the calculated length of one side, the area of an equilateral triangle was calculated and determined as the area of the central portion. For example, the area of the central portion is the area of the equilateral triangle (central portion) represented by C in FIG. 4. For the cross sections including two or four protrusions, the vertical length and the horizontal length of the central portion were measured (5 cross sections×4 sides), and the average of the vertical lengths and the average of the horizontal lengths were calculated. Based on these average values, the area of a quadrangle was calculated and determined as the area of the central portion.

(Method for Measuring Torsional Rigidity)

Using a torsion tester (KES-YN1, manufactured by KATO TECH CO., LTD.), the torsional rigidity of a sample (single yarn) with a length of 3 cm was measured under the conditions that the number of twists was ±3 twists and the torsion speed was 12°/sec. The average of 5 measurements was calculated as the value of the torsional rigidity (unit: $mg \cdot cm^2$).

(Method for Measuring Flexural Rigidity)

Using a pure bending tester (KES-FB2, manufactured by KATO TECH CO., LTD.), the flexural rigidity was measured as follows.

Forty-nine fibers (single yarns) were attached to a mount at intervals of 1 mm, and the fibers were fixed on the top and the bottom with a cellophane tape so as not to come loose. The obtained sample was fixed to a jig of the apparatus and measured at a deformation rate of 0.5 cm/sec with a curvature of −2.5 to +2.5 ($cm^{-1}$). The average of repulsion was measured when the curvature was in the range of 0.5 to 1.5 ($cm^{-1}$). Then, the value per fiber was calculated and determined as the flexural rigidity.

(Method for Evaluating Volume)

<Preparation of Sample>

About 270 g of acrylic fibers were processed at a take-up speed of 1.5 to 2 m/min, a gear temperature of 90 to 100° C., and a gear pitch of 2.5 mm to have a crimp angle of 141°±3° (the average of 5 fibers, each of which had been measured at one point). Thus, a crimped tow was obtained.

<Evaluation of Volume>

A professional beauty evaluator made two BRDs (braids) using the crimped tow of 45.7 cm×4 g (length×weight) for each braid. The width and thickness of one BRD were measured at 10 points each by a vernier caliper. Based on the average of the widths and the average of the thicknesses of the two BRDs, the width and the thickness were calculated. Next, the product of the width and the thickness (width×thickness) was calculated as a volume evaluation value. The ratio of the volume evaluation value to a volume evaluation value at a comparative level (Comparative Example 2) was calculated and determined as a volume increase rate. If the volume increase rate was 10% or more, the sample was successful (good). If the volume increase rate was less than 10%, the sample was unsuccessful.

(Method for Evaluating Texture)

Three professional beauty evaluators conducted a sensory evaluation using a hair bundle of 30 cm×30 g (length×weight). In this case, the professional beauty evaluators graded each hair bundle according to the degree of texture on a scale of 1 to 5, where 5 was a comparative level (Comparative Example 2, in which the texture of the fibers was very similar to human hair). Then, the average score was calculated. Based on the average score, the texture was evaluated in the following three stages.

A: 4.0 or more and 5.0 or less

B: more than 2.0 and 4.0 or less

C: 2.0 or less (Method for Evaluating Twist Processability)

A crimped tow was obtained in the same manner as the volume evaluation method. A professional beauty evaluator made a TWIST (composed of two strands) using the crimped tow of 45.7 cm×2 to 2.6 g for each strand. The twist processability was evaluated in the following three stages.

A: The twist processability was very good.

B: The twist processability was good.

C: The twist processability was poor.

(Method for Evaluating HWS Properties)

A hair bundle with a length of 20 inches (50.8 cm) and a weight of 2 g was used. The hair bundle was wrapped around a pipe (metal cylinder) with a diameter of 7 mm and fixed, and immersed in hot water at 90° C. for 15 seconds. Subsequently, the hair bundle was left drying in a dryer (40° C.) for 2 hours. The dried hair bundle was removed from the pipe and immediately loosened, e.g., by pinching the fibers, so that the hair bundle was undone. Then, the hair bundle was hung, and the length of the hair bundle immediately after hanging was measured. Using the length of a hair bundle immediately after hanging in Comparative Example 2 as a control level, the measured length of the hair bundle immediately after hanging was evaluated in the following three stages.

A: The length immediately after hanging was +1 cm or less of the control level.

B: The length immediately after hanging was more than +1.1 cm and 2.0 cm or less of the control level.

C: The length immediately after hanging was more than +2.0 cm of the control level.

TABLE 4

| | H (μm) | Lx (μm) | Ln (μm) | H/circumradius (%) | Lx/Ln (times) |
|---|---|---|---|---|---|
| Ex. 1 | 18.3 | 50.6 | 20.5 | 33.3 | 2.5 |
| Ex. 2 | 19.4 | 54.3 | 26.3 | 38.5 | 2.1 |
| Ex. 3 | 20.0 | 52.1 | 27.1 | 43.5 | 1.9 |
| Ex. 4 | 16.6 | 59.1 | 23.5 | 29.6 | 2.5 |
| Ex. 5 | 17.7 | 56.9 | 25.6 | 32.4 | 2.2 |
| Ex. 6 | 18.7 | 53.4 | 22.8 | 35.2 | 2.3 |
| Ex. 7 | 18.7 | 53.4 | 22.8 | 35.2 | 2.3 |
| Ex. 8 | 18.7 | 53.4 | 22.8 | 35.2 | 2.3 |
| Ex. 9 | 18.4 | 44.6 | 17.2 | 31.7 | 2.6 |
| Ex. 10 | 18.0 | 42.5 | 21.3 | 34.0 | 2.0 |
| Ex. 11 | 18.5 | 52.6 | 22.8 | 39.0 | 2.3 |
| Ex. 12 | 19.1 | 50.0 | 21.2 | 43.3 | 2.4 |
| Ex. 13 | 18.2 | 54.4 | 21.2 | 35.3 | 2.6 |
| Ex. 14 | 19.1 | 53.1 | 22.2 | 39.0 | 2.4 |
| Ex. 15 | 20.3 | 54.9 | 21.2 | 43.7 | 2.6 |
| Ex. 16 | 20.8 | 52.4 | 22.8 | 48.3 | 2.4 |
| Ex. 17 | 16.9 | 44.1 | 17.0 | 36.0 | 2.6 |
| Ex. 18 | 16.9 | 46.4 | 18.4 | 34.8 | 2.5 |
| Ex. 19 | 16.3 | 47.0 | 16.1 | 34.7 | 2.9 |
| Comp. Ex. 1 | — | 26.0 | 26.0 | — | 1.0 |
| Comp. Ex. 2 | 30.6 | 60.3 | 28.0 | 80.4 | 2.2 |
| Comp. Ex. 3 | 25.2 | 29.0 | 16.2 | 38.8 | 1.8 |

As can be seen from FIG. 5, the acrylic fibers in Example 5 had a fiber cross section including three T-shaped protrusions that extended radially from the central portion, and each of the T-shaped protrusions had an arc-shaped upper side that bulged in the direction away from the central portion. Similarly, the acrylic fibers in the other Examples, although not shown in the figures, had a fiber cress section including three T-shaped protrusions that extended radially from the central portion, and each of the T-shaped protrusions had an arc-shaped upper side that bulged in the

TABLE 3

| | Fiber cross section | | | | | Evaluation item | | | | | | |
|---|---|---|---|---|---|---|---|---|---|---|---|---|
| | Number of protrusions | Circumradius (μm) | Axial width (μm) | Canal width (μm) | Area of central portion ($\mu m^2$) | Torsional rigidity ($mg \cdot cm^2$) | Flexural rigidity ($10^{-3}$ gf · $cm^2$/yarn) | Volume increase rate (%) | Texture | Twist processability | HWS properties | Fineness (dtex) |
| Ex. 1 | 3 | 55.0 | 14 | 24.1 | 230.9 | 0.843 | 7.95 | 29 | B | A | C | 51 |
| Ex. 2 | 3 | 50.5 | 15 | 22.9 | 129.9 | 1.183 | 5.90 | 20 | A | B | B | 51 |
| Ex. 3 | 3 | 46.0 | 19 | 16.0 | 208.4 | 1.298 | 4.80 | 11 | A | B | B | 51 |
| Ex. 4 | 3 | 56.0 | 11 | 26.7 | 158.9 | 0.973 | 7.50 | 32 | B | A | C | 51 |
| Ex. 5 | 3 | 54.5 | 12 | 28.0 | 145.0 | 1.153 | 6.60 | 26 | B | B | C | 51 |
| Ex. 6 | 3 | 53.0 | 11 | 20.1 | 114.6 | 0.795 | 5.80 | 24 | B | A | C | 46 |
| Ex. 7 | 3 | 53.0 | 11 | 20.1 | 114.6 | 0.795 | 5.80 | 24 | A | A | C | 46 |
| Ex. 8 | 3 | 53.0 | 11 | 20.1 | 114.6 | 0.795 | 5.80 | 24 | B | A | C | 46 |
| Ex. 9 | 3 | 58.0 | 14 | 48.0 | 412.2 | 1.525 | 8.50 | 68 | B | B | B | 51 |
| Ex. 10 | 3 | 53.0 | 16 | 42.9 | 492.9 | 1.914 | 8.70 | 27 | B | B | B | 51 |
| Ex. 11 | 3 | 47.5 | 15 | 9.88 | 211.1 | 1.15 | 8.40 | 33 | A | B | B | 46 |
| Ex. 12 | 3 | 44.0 | 12 | 6.75 | 174.8 | 0.805 | 6.80 | 24 | A | A | B | 43 |
| Ex. 13 | 3 | 51.5 | 11 | 19.66 | 185.4 | 0.7025 | 9.90 | 59 | A | A | B | 46 |
| Ex. 14 | 3 | 49.0 | 12 | 17.6 | 220.7 | 0.9775 | 9.10 | 50 | A | A | B | 46 |
| Ex. 15 | 3 | 46.5 | 13 | 7.6 | 158.5 | 0.9500 | 9.20 | 38 | A | A | B | 46 |
| Ex. 16 | 3 | 43.0 | 14 | 4.63 | 239.5 | 1.22 | 5.80 | 30 | A | B | B | 46 |
| Ex. 17 | 3 | 47.0 | 13.1 | 6.39 | 405.4 | 1.263 | 8.10 | 24 | A | B | B | 51 |
| Ex. 18 | 3 | 48.5 | 14.7 | 9.15 | 326.8 | 1.245 | 8.90 | 38 | A | B | B | 51 |
| Ex. 19 | 3 | 47.0 | 14.0 | 7.80 | 337.6 | 1.355 | 7.90 | 36 | A | B | B | 51 |
| Comp. Ex. 1 | 3 | 60.0 | 26 | 74.2 | 748.2 | 2.670 | 9.70 | 49 | C | C | A | 51 |
| Comp. Ex. 2 | 2 | 38.0 | 28 | 15.7 | 353.2 | 3.850 | 3.85 | 0 (Comparative level) | 5 (Comparative level) | 1 (Comparative level) | A | 46 |
| Comp. Ex. 3 | 3 | 65.0 | 14 | 80.4 | 668.6 | 2.230 | 9.90 | 48 | C | C | A | 51 |

direction away from the central portion. As shown in Table 4, in the Examples, H/circumradius was 29.6% or more and 48.3% or less, and Lx/Ln was 1.9 times or more and 2.9 times or less.

As can be seen from the results of Table 3, the acrylic fibers in Examples 1 to 19 had a high volume, a good texture, and good twist processability. Comparing Examples 6, 7, and 8, it was found that the acrylic fibers had a better texture when the fatty acid ester oil and the polyoxyethylene surfactant, which had been generally used to improve the feel of acrylic fibers, were combined with the aliphatic amide cationic compound than when these components were used individually.

On the other hand, in Comparative Example 1, the distance between the adjacent end portions of the upper sides of a Y-shaped protrusion was more than 60.0 μm and the torsional rigidity was more than 2.0 mg·cm$^2$. Thus, the acrylic fibers had a poor texture and poor twist processability. In Comparative Example 2, the circumradius was less than 40.0 μm and the torsional rigidity was more than 2.0 mg·cm$^2$. Thus, the acrylic fibers had a low volume and poor twist processability. In Comparative Example 3, the circumradius was more than 60.0 μm, the distance between the adjacent end portions of the upper sides of a Y-shaped protrusion was more than 60.0 μm, and the torsional rigidity was more than 2.0 mg·cm$^2$. Thus, the acrylic fibers had a poor texture and poor twist processability.

DESCRIPTION OF REFERENCE NUMERALS

1 Acrylic fiber for artificial hair
2 Central portion
3 T-shaped protrusion
4 Upper side (portion) of T-shaped protrusion
5 Lower extended portion of T-shaped protrusion Although some embodiments have been described herein, those skilled in the art, having the benefit of this disclosure, will appreciate that various other embodiments may be devised without departing from the scope of the present disclosure.

The invention claimed is:

1. An acrylic fiber for artificial hair comprising an acrylic copolymer, wherein the acrylic fiber has a fiber cross section comprising 2 or more and 4 or less T-shaped protrusions that extend radially from a central portion, and each of the T-shaped protrusions has an arc-shaped upper side that bulges in a direction away from the central portion, wherein a circumradius of the fiber cross section is 40.0 μm or more and 60.0 μm or less, a distance between adjacent end portions of corresponding upper sides of adjacent T-shaped protrusions is 3.0 μm or more and 60.0 μm or less, and an axial width is 10.0 μm or more, and a torsional rigidity of the acrylic fiber is 0.30 mg·cm$^2$ or more and 2.0 mg·cm$^2$ or less.

2. The acrylic fiber for artificial hair according to claim 1, wherein the circumradius of the fiber cross section is 45.0 μm or more and 60.0 μm or less, the distance between the adjacent end portions of the corresponding upper sides of the adjacent T-shaped protrusions is 10.0 μm or more and 60 μm or less, the axial width is 11.0 μm or more, and an area of the central portion is 600.0 μm$^2$ or less.

3. The acrylic fiber for artificial hair according to claim 1, wherein a thickness of an upper side portion of at least one T-shaped protrusion is 10% or more and 50% or less of the circumradius of the fiber cross section.

4. The acrylic fiber for artificial hair according to claim 1, wherein a maximum length of an upper side portion of at least one T-shaped protrusion is 1.5 times or more and 4 times or less a minimum length of the upper side portion of the T-shaped protrusion.

5. The acrylic fiber for artificial hair according to claim 1, wherein a fiber treatment agent adheres to the acrylic fiber, and the fiber treatment agent comprises a fatty acid ester oil, a polyoxyethylene surfactant, and an aliphatic amide cationic compound.

6. The acrylic fiber for artificial hair according claim 1, wherein the acrylic copolymer comprises 29.5% by weight or more and 79.5% by weight or less of acrylonitrile, 20% by weight or more and 70% by weight or less of at least one monomer selected from the group consisting of vinyl chloride and vinylidene chloride, and 0.5% by weight or more and 5% by weight or less of a sulfonic acid group-containing vinyl monomer with respect to 100% by weight of a total amount of the acrylic copolymer.

7. The acrylic fiber for artificial hair according to claim 1, wherein a flexural rigidity of the acrylic fiber is $4.0\times10^{-3}$ gf·cm$^2$/yarn or more.

8. A hair ornament comprising the acrylic fiber for artificial hair according to claim 1.

9. The hair ornament according to claim 8, wherein the hair ornament is at least one selected from the group consisting of a fiber bundle for hair, a hair weave, a wig, a braid, a toupee, a hair extension, and a hair accessory.

* * * * *